US006002893A

United States Patent [19]

Caruthers, Jr. et al.

[11] Patent Number: 6,002,893

[45] Date of Patent: Dec. 14, 1999

[54] HIGH AND LOW PIGMENT LOADINGS FOR CUSTOM COLORS

[75] Inventors: Edward B. Caruthers, Jr., Rochester; John W. Spiewak, Webster; George A. Gibson, Fairport, all of N.Y.

[73] Assignee: Xerox Corporation, Stamford, Conn.

[21] Appl. No.: 09/190,702

[22] Filed: Nov. 12, 1998

Related U.S. Application Data

[60] Provisional application No. 60/070,828, Jan. 8, 1998.

[51] Int. Cl.[6] ..... G03G 15/01

[52] U.S. Cl. ..... 399/54; 399/233

[58] Field of Search ..... 399/57, 58, 233, 399/237, 49, 39, 54, 223; 430/117

[56] References Cited

U.S. PATENT DOCUMENTS

| | | | |
|---|---|---|---|
| 4,943,834 | 7/1990 | Maeda et al. | 399/39 X |
| 5,121,164 | 6/1992 | Landa et al. . | |
| 5,240,806 | 8/1993 | Tang et al. . | |
| 5,254,978 | 10/1993 | Beretta . | |
| 5,330,868 | 7/1994 | Santilli et al. . | |
| 5,369,476 | 11/1994 | Bowers et al. . | |
| 5,471,313 | 11/1995 | Thieret et al. . | |
| 5,512,978 | 4/1996 | Mosher et al. . | |
| 5,519,497 | 5/1996 | Hubble, III et al. . | |
| 5,543,896 | 8/1996 | Mestha . | |
| 5,557,393 | 9/1996 | Goodman et al. . | |
| 5,713,062 | 1/1998 | Goodman et al. | 399/49 |
| 5,722,017 | 2/1998 | Caruthers, Jr. et al. | 399/57 X |
| 5,749,021 | 5/1998 | Mestha et al. | 399/49 |
| 5,781,828 | 7/1998 | Caruthers, Jr. et al. | 399/57 |
| 5,897,239 | 4/1999 | Caruthers, Jr. et al. | 399/54 |

OTHER PUBLICATIONS

Xerox Disclosure Journal, "Custom Color Liquid Ink Development", by Nancy B. Goodman, vol. 21, No. 2, Mar./Apr., 1996, p. 155.

Xerox Disclosure Journal, "Custom Color Liquid Ink Development (LID) Process", by Nancy B. Goodman, vol. 21, No. 2, Mar./Apr., 1996, p. 157.

*Primary Examiner*—Susan S.Y. Lee

[57] ABSTRACT

Custom color control techniques are extended by using a high and a low pigment loaded toner for each color of the primary colors in the printing system. In one application, a large gamut of colors and fine control of color is accomplished by using a minimum number of colored pigments with each color incorporated into both high and low pigment loaded toners. Another application of the high/low pigment loaded toners is the ability to increase the developed mass per unit area (DMA) for rough papers without increasing pigment mass per unit area (PMA) by either mixing high and low pigment-loaded toners or by mixing a high pigment-loaded toner with an unpigmented toner to obtain the desired custom color. A novel sensor which senses fluorescent molecules in toner particles provides a color independent measure of total toner solids.

11 Claims, 1 Drawing Sheet

HIGH AND LOW PIGMENT LOADINGS FOR CUSTOM COLORS

This patent application claims priority to U.S. Provisional Patent Application Ser. No. 60/070,828 filed Jan. 8, 1998.

This invention relates generally to a method and apparatus for creating custom color images in a printing process and more particularly relates to a system for producing custom color images employing high and low pigment loadings in an electrostatographic printing system using dry or liquid developing materials. This invention enables the creation of a wide gamut of custom colors with relatively few process colors in many printing and painting systems, such as, xerography, lithography, letterpress, gravure, and automobile painting. Although examples of the use of this invention will be given in electrostatographic copying and printing environments, it should be remembered that this invention includes all uses of the methods disclosed for controlling the composition of a mixture of colorants.

Generally, the process of electrostatographic copying and printing is initiated by exposing a light image of an original input document or signal onto a substantially uniformly charged photoreceptive member. Exposing the charged photoreceptive member to a light image discharges selective areas of the photoreceptive member, creating an electrostatic latent image on the photoreceptive member corresponding to the original input document or signal. This latent image is subsequently developed into a visible image by a process in which developing material is deposited onto the surface of the photoreceptive member. Typically, the developing material comprises carrier granules having toner particles adhering triboelectrically thereto, wherein the toner particles are electrostatically attracted from the carrier granules to the latent image to create a powder toner image on the photoreceptive member. Alternatively, liquid developing materials comprising pigmented marking particles (or so-called toner solids) and charge directors dispersed in a carrier liquid have been utilized, wherein the liquid developing material is applied to the latent image with the marking particles being attracted toward the image areas to form a developed liquid image. Regardless of the type of developing material employed, the toner or marking particles of the developing material are electrostatically attracted to the latent image to form a developed image and the developed image is subsequently transferred from the photoreceptive member to a copy substrate, either directly or via an intermediate transfer member. Once on the copy substrate, the image may be permanently affixed to provide a "hard copy" output document. In a final step, the photoreceptive member is cleaned to remove any charge and/or residual developing material from the photoconductive surface in preparation for subsequent imaging cycles.

The above-described electrostatographic reproduction process is well known and is useful for so-called light lens copying from an original document, as well as for printing of electronically generated or stored images where the electrostatic latent image is formed via a modulated laser beam. Analogous processes also exist in other printing applications such as, for example, ionographic printing and reproduction where charge is deposited in image configuration on a charge retentive surface (see, for example, U.S. Pat. Nos. 4,267,556 and 4,885,220, among numerous other patents and publications). Some of these printing processes, such as light lens generated image systems operate in a manner wherein the charged areas are developed (so-called CAD, or "write white" systems), while other printing processes operate in a manner such that discharged areas are developed (so-called DAD, or "write black" systems). It will be understood that the instant invention applies to all various types of electrostatographic printing systems and is not intended to be limited by the manner in which the image is formed or developed.

It is well known that conventional electrostatographic reproduction processes can be adapted to produce multicolor images. For example, the charged photoconductive member may be sequentially exposed to a series of color separated images corresponding to the primary colors in an input image in order to form a plurality of color separated latent images. Each color separated image is developed with a complimentary developing material containing a primary color or a colorant which is the subtractive compliment of the color separated image, with each developed color separated image subsequently superimposed, in registration, on one another to produce a multicolor image output. Thus, a multicolor image is generated from patterns of different primary colors or their subtractive compliments which are blended by the eye to create a visual perception of a color image.

This procedure of separating and superimposing color images produces so-called "process color" images, wherein each color separated image comprises an arrangement of picture elements, or pixels, corresponding to a spot to be developed with toner particles of a particular color. The multicolor image is a mosaic of different color pixels, wherein the color separations are laid down in the form of halftone dots. In halftone image processing, the dot densities of each of the color components making up the multicolor image can be altered to produce a large variation of color hues and shades. For example, lighter tints can be produced by reducing the dot densities such that a greater amount of white from the page surface remains uncovered to reflect light to the eye. Likewise, darker shades can be produced by increasing the dot densities. This method of generating process color images by overlapping halftones of different colors corresponding to the primary colors or their subtractive equivalents is well known in the art and will not be further described herein.

With the capabilities of electrostatographic technology moving into multicolor imaging, advances have also been directed to the creation of so-called "highlight color" images, wherein independent, differently colored, monochrome images are created on a single output copy sheet, preferably in a single processing cycle. Likewise, "spot color" and/or "high-fidelity" color printing have been developed, wherein a printing system capable of producing process color output images is augmented with an additional developer housing containing an additional color beyond the primary or subtractive colors used to produce the process color output. This additional developer housing is used for developing an independent image with a specific color (spot color) or for extending the color gamut of the process color output (high fidelity color). As such, several concepts derived from conventional electrostatographic imaging techniques which were previously directed to monochrome and/or process color image formation have been modified to generate output images having selected areas that are different in color than the rest of the document. Applications of highlight spot and high fidelity color include, for example, emphasis on important information, accentuation of titles, and more generally, differentiation of specific areas of text or other image information.

One exemplary highlight color process is described in U.S. Pat. No. 4,078,929 to Gundlach, wherein independent images are created using a raster output scanner to form a tri-level image including a pair of image areas having different potential values and a non-image background area generally having a potential value intermediate the two image areas. As disclosed therein, the charge pattern is developed with toner particles of first and second colors, where the toner particles of one of the colors are positively charged and the toner particles of the other color are negatively charged, therefore producing a highlight color image.

One specific application of highlight color processing is customer selectable color printing, wherein a very specific highlight color is required. Customer selectable colors are typically utilized to provide instant identification and authenticity to a document. As such, the customer is usually highly concerned that the color meets particular color specifications. For example, the red color associated with Xerox' digital stylized "X" is a customer selectable color having a particular shade, hue and color value. Likewise, the particular shade of orange associated with Syracuse University is a good example of a customer selectable color. A more specialized example of customer selectable color output can be found in the field of custom color, which specifically refers to registered proprietary colors, such as used, for example, in corporate logos, authorized letterhead and official seals. The yellow associated with Kodak brand products, and the brown associated with Hershey brand products are good examples of custom colors which are required to meet exacting color standards in a highlight color or spot color printing application.

The various colors typically utilized for standard highlighting processes generally do not precisely match customer selectable colors. Moreover, customer selectable colors typically cannot be accurately generated via halftone process color methods because the production of solid image areas of a particular color using halftone image processing techniques typically yields nonuniformity of the color in the image area. Further, lines and text produced by halftone process color are very sensitive to misregistration of the multiple color images such that blurring, color variances. and other image quality defects may result.

As a result of the deficiencies noted above, customer selectable color production in electrostatographic printing systems is typically carried out by providing a singular premixed developing material composition made up of a mixture of multiple color toner particles blended in preselected concentrations for producing the desired customer selectable color output. This method of mixing multiple color toners to produce a particular color developing material is analogous to processes used to produce customer selectable color paints and inks. In offset printing, for example, a customer selectable color output image is produced by printing a solid image pattern with a premixed customer selectable color printing ink as opposed to printing a plurality of halftone image patterns with various primary colors or compliments thereof. This concept has generally been extended to electrostatographic printing technology, as disclosed, for example, in commonly assigned U.S. Pat. No. 5,557,393, wherein an electrostatic latent image is developed by a dry powder developing material comprising two or more compatible toner compositions to produce a customer selectable color output.

Customer selectable color printing materials including paints, printing inks and developing materials can be manufactured by determining precise amounts of constituent basic color components making up a given customer selectable color material, providing precisely measured amounts of each constituent basic color component, and thoroughly mixing these color components. This process is commonly facilitated by reference to a color guide or swatch book containing hundreds or even thousands of swatches illustrating different colors, wherein each color swatch is associated with a specific formulation of colorants. Probably the most popular of these color guides is published by Pantone®, Inc. of Moonachie, N.J. The Pantone® Color Formula Guide expresses colors using a certified matching system and provides the precise formulation necessary to produce a specific customer selectable color by physically intermixing predetermined concentrations of up to four colors from a set of up to 18 principal or basic colors. There are many colors available using the Pantone® system or other color formula guides of this nature that cannot be produced via typical halftone process color methods.

In the typical operational environment, an electrostatographic printing system may be used to print various customer selectable color documents. To that end, replaceable containers of premixed customer selectable color developing materials corresponding to each customer selectable color are provided for each print job. Replacement of the premixed customer selectable color or substitution of another premixed color between different print jobs necessitates operator intervention which typically requires manual labor, among other undesirable requirements. In addition, since each customer selectable color is typically manufactured at an off-site location, supplies of each customer selectable color printing ink must be separately stored for each customer selectable color print job.

The patent literature is replete with control systems for controlling electrostatographic processing parameters in response to the quality of the image produced by means of maintaining a test image or patch. For example, it is now common practice to provide a scanning device to sense optical density or other characteristics of a development test patch in order to generate a control response signal to adjust machine operation for print quality. Public demand for increased color quality and selectability has necessitated the development of various solutions and control mechanisms in response to particular requirements.

In a typical liquid developing material-based electrostatographic system, a liquid developing material reservoir is continuously replenished by the addition of various components making up the liquid developing material: namely liquid carrier, charge director, and a concentrated dispersion of toner particles in the carrier liquid, as necessary. This replenishment must be constantly monitored and controlled to provide a predetermined concentration of toner particles, liquid carrier, and charge director in the liquid developing material reservoir. The present invention builds on that concept by providing a system in which the concentration levels of each of the basic color components making up the customer selectable color material mixture in an operative material supply reservoir are measured and controlled, both to provide an initial match to the customer selectable color image and to maintain that match by replenishing the various basic color components in proportion as they are used in the printing process. Thus, the present invention contemplates a printing system including a color mixing and control system, wherein the color value of the material in a supply reservoir can be controlled and the rate of replenishment of various color components added to the supply reservoir can be selectively varied. By adding precise amounts of specific colors from a set of basic color components, the actual color of the material in the reservoir is brought into agreement with a predetermined selected color in order to produce a wide range of customer selectable colors. This process is initially used to automatically mix basic color components to match the customer selected color and is used repeatedly throughout the printing process to replenish basic color components to maintain the customer selected color. Moreover, by monitoring the output color of an image produced by the mixed color materials, and controlling the replenishment process in response thereto, a wide range of customer selectable colors can be produced and maintained over very long print runs.

The following disclosures may be relevant to some aspects of the present invention:

U.S. Pat. No. 5,557,393
Inventor: Goodman et al.
Issued: Sep. 17,1996
U.S. Pat. No. 5,543,896
Inventor: Mestha
Issued: Aug. 6, 1996
U.S. Pat. No. 5,369,476
Inventor: Bowers et al.
Issued: Nov. 29, 1994
U.S. Pat. No. 5,240,806
Inventor: Tang et. al.
Issued: Aug. 31, 1993
U.S. Pat. No. 5,254,978
Inventor: Beretta
Issued: Oct. 19, 1993
U.S. Pat. No. 5,471,313
Inventor: Thieret et al.
Issued: Nov. 28, 1995
U.S. Pat. No. 5,512,978
Inventor: Mosher et al.
Issued: Apr. 30, 1996
U.S. Pat. No. 5,330,868
Inventor: Santilli et al.
Issued: Jul. 19, 1994

The relevant portions of these referenced patents and disclosures may be briefly summarized as follows:

U.S. Pat. No. 5,557,393 discloses an electrostatographic imaging process including the formation of an electrostatic latent image on an image forming device, developing the electrostatic latent image on the image forming device with at least one developer containing carrier particles and a blend of two of more compatible toner compositions, and transferring the toner image to a receiving substrate and fixing it thereto. Among the compatible toner compositions that may be selected are toner compositions having blend compatible components coated on an external surface of the toner particles and particulate toner compositions containing therein blend compatible components or passivated pigments. Electrostatographic imaging devices, including a tri-level imaging device and a hybrid scavengeless development imaging device, are also provided for carrying out the described process. This process is especially useful in imaging processes for producing single color or highlight color images using customer selectable colors, or for adding highlight color to a process color image.

U.S. Pat. No. 5,543,896 discloses a method for measurement of tone reproduction curves using a single structured patch for providing development control by storing a reference tone reproduction curve and providing a single test pattern including a scale of pixel values in an interdocument zone on a photoreceptor surface. The test pattern is sensed in the interdocument zone and a control response to the sensing of the test pattern is provided with reference to the toner reproduction curve in order to adjust the machine operation for print quality correction.

U.S. Pat. No. 5,369,476 discloses a toner control system and method for electrographic printing in which toner is delivered from a reservoir to a toner fountain for application to an electrostatically charged sheet to form an image. The visual quality of the image is monitored, and toner concentrate is added to the toner in response to the monitored quality to increase the amount of pigment particles in the toner and to thereby maintain a substantially constant image quality. In the disclosed embodiments, a test image is formed outside the main image on the sheet, and the brightness of one or more predetermined colors in the test image is monitored.

U.S. Pat. No. 5,240,806 discloses a liquid color toner composition for use in contact and gap electrostatic transfer processes, wherein the toner comprises a colored predispersion including: a non-polymeric resin material having certain insolubility (and non-swellability), melting point, and acid number characteristics; and alkoxylated alcohol having certain insolubility (and non-swellability) and melting point characteristics; and colorant material having certain particle size characteristics. The toner further comprises an aliphatic hydrocarbon liquid carrier having certain conductivity, dielectric constant, and flash point.

Xerox Disclosure Journal, Vol. 21, No. 2, pp. 155–157 discloses customer selectable color liquid ink development and a customer selectable color liquid ink development process wherein two or more liquid colored inks are applied simultaneously, in proper predetermined relative amounts, to provide custom or customer specified color images. The processes comprise, for example, providing a liquid development apparatus with at least one developer housing containing a liquid developer comprised of at least two different colored inks that are premixed at a desired concentration ratio, and developing a latent image with the premixed liquid developer to afford customer selectable colored developed images.

U.S. Pat. No. 5,254,978 teaches a reference color selection system for creating a palette of colorimetrically measured colors. Palettes of colorimetrically measured colors representing naturally occurring objects and specified using a standard device independent color specification, such as the CIE color specification, are arranged in a data base. A simple to use color selection user interface permits a user to retrieve, view and modify each palette. Each color is transformed into coordinates in a uniform color space, such as the CIELAB space. The user may delete colors not needed and may create new colors for the palette by mixing two existing palette colors together.

U.S. Pat. No. 5,471,313 uses a control system for an image output terminal with a hierarchical structure which isolates subsystem controls for purposes of efficient algorithm design, analysis and implementation. The architecture is divided into three levels and has a controls supervisor which provides subsystem isolation functions and reliability assurance functions. The architecture improves image quality of IOT outputs by controlling the operation of the IOT to insure that a tone reproduction curve of an output image matches a tone reproduction curve of an input image, despite several uncontrollable variables which change the tone reproduction curve of the output image.

U.S. Pat. No. 5,512,978 discloses an apparatus for measuring concentrations of a first vapor pressure carrier fluid component and a second vapor pressure carrier fluid component in a carrier fluid mixture including a supply vessel for holding the carrier fluid mixture. A light source is provided for transmitting an infrared light source to the carrier fluid mixture. A detector is provided for detecting infrared light intensity transmitted through the carrier fluid mixture and in response thereto determining infrared absorption of carbon hydrogen stretching frequencies of the carrier fluid mixture. The concentrations of the first carrier fluid components and the second carrier fluid component are calculated based on the infrared absorption of carbon hydrogen stretching frequencies of the carrier fluid mixture. This method can also be extended to a mixture of more than two fluids.

U.S. Pat. No. 5,330,868 teaches an electrographic liquid developer including a fluorescent toner diluted in a liquid developer which has a high flash point and a low vapor pressure. The fluorescent toner is made from a solution which comprises an organic solvent, a fluorescent dye and an organic polymer. A pigment is precipitated by mixing the solution with a non-solvent for the polymer in the presence of a dispersant. The pigment is melt-compounded with a polymeric organic binder and the melt-compounded mixture is comminuted.

"Color Mixing and Control System for use in an Electrostatographic Printing Machine" by Goodman et al., U.S. Ser. No. 08/721,420, filed Sep. 26, 1996, now U.S. Pat. No. 5,713,062 and assigned to the same assignee as the present patent application, teaches an operative mixture of colored developing material which is continuously replenished with selectively variable amounts of developing materials of basic color components making up the operative mixture. The rate of replenishment of various color components added to the operative mixture is controlled to provide a mixture of developing material capable of producing a customer selectable color on an output copy substrate. A calorimeter is provided for monitoring the color of a test image printed with the operative mixture of developing material in the supply reservoir so that the color thereof can be brought into agreement with a color required to produce the customer selectable output color.

"Color Mixing and Control System for use in an Electrostatographic Printing Machine" by Caruthers, Jr. et al. filed Sep. 26, 1996, U.S. patent Ser. No. 08/721,419 and assigned to the same assignee as the present invention discloses a developing reservoir containing an operative solution of customer selectable colored developing material that is continuously replenished with selectively variable amounts of basic color components making up the operative solutions by controlling the rate of replenishment of various color components added to the supply reservoir. A spectrophotometer is used to measure the optical spectrum of the developing material in the supply reservoir so that the actual optical spectrum thereof can be brought into agreement with a target optical spectrum associated with a customer selectable color.

"Color and Replenishment System for an Electrostatographic Printing Machine" by Caruthers, Jr. et al. filed Sep. 26, 1996, U.S. patent Ser. No. 08/721,422, now U.S. Pat. No. 5,781,828 issued Jul. 14, 1998 and assigned to the same assignee as the present invention includes a system and method for color mixing in which a developing material reservoir containing an operative solution of colored developing material including a mixture of selected color components which is continuously replenished with selected differently colored developing material concentrates in a predetermined ratio so as to be capable of producing a customer selectable color image area on an output substrate. The system may also be used to mix a customer selectable color in situ either from stored proportions known to compensate for developablity differences or from approximate amounts of primary color components initially deposited and mixed in the developing material reservoir with the resultant operative developing material mixture continually developed and replenished with a predetermined ratio of color components until the developing material mixture reaches a steady state color.

"Photometric Color Correction and Control System for Custom Colors" by Caruthers et al., and assigned to the same assignee as the present invention referred to as D/95434, U.S. Ser. No. 08/831,454, filed Mar. 31, 1997, now U.S. Pat. No. 5,897,239, teaches mixing a customer selectable color in situ. Approximate amounts of primary color components are initially deposited and mixed in a developing material reservoir and the resultant developed image is monitored and adjusted until the mixture reaches a target optical spectrum. An additional optical sensor may be used to control and maintain the color of the developing material in the reservoir through continuous monitoring and correction in order to maintain a particular ratio of color components in the reservoir over extended periods associated with very long print runs.

All of the above cited references are hereby incorporated by reference.

The Pantone Color Matching System (CMS)® contains recipes for, and samples of, 972 colors that are made by combining 2–4 primary inks from the Pantone set of 18 primary inks. These custom colors expand the gamut of printable colors far beyond that which can be printed from the usual cyan, magenta, yellow and black process colors. The Pantone primary colors include sets of similar colors, for example, four reds, which improve the precision with which colors can be mixed and final color controlled. Liquid xerography offers the significant advantage of easy mixing of colors in a liquid toner development tank. This enables automatic mixing of basic color components within the print engine. One aspect of the present invention uses high and low pigment loading to extend other techniques of custom color production to minimize the number of primary pigments which must be used in formulating the custom colors. Another aspect of this invention provides automatic mixing of basic color components to match a customer selected color. Another aspect of this invention provides automatic adjustment of basic color components to prevent the printed color from diverging from the customer selected color during printing.

Currently, the principle method of measuring toner concentration in a liquid xerographic toner is by optical attenuation as described in some of the above references. This method works well for four color (C, M, Y, K) process color printing, however, it is desirable to be able to print a large number of custom colors (e.g. about 1000 in the Pantone color system). For a mixture of two colors (e.g. blue and red), the toner transmission spectrum is measured and used to add components as necessary. However, many custom colors include white or black components and in order to control white or black component and a color component, including high and low pigment loadings, it is useful to have an independent measure of total toner solids.

When printing on rough papers it is desirable to develop more mass per unit area than when printing on smooth papers. On a microscopic scale, rough papers have more surface area to be covered than do smooth papers. However, whether printing process or customer selected colors, it is desirable to maintain solid area optical densities at approximately the same levels on both rough and smooth papers.

Printing of process color (overlays of Cyan, Magenta, Yellow and/or Black halftone patterns) requires that individual toner layers be somewhat transparent. A color close to the paper must be visible through a color above it. Due to the overlapping absorption bands of the toners, this limits the optical thickness of each toner layer. One common way to keep the right optical thickness of the layers is to keep Solid Area optical Densities (SADs) at target values. Standard SADs of printing inks or xerographic toners printed onto smooth, glossy papers are about 1.1–1.2 for Yellow, 1.2–1.3 for Cyan, 1.3–1.4 for Magenta and 1.4–1.5 for Black. To keep the optical thickness of the layers constant requires that the pigment mass per unit area (PMA) be kept approximately constant. Current liquid xerographic toners have approximately 20% weight pigment, the rest of the toner particle being resin and charge coupling agent. For this pigment loading, the developed masses per unit area (DMAs) that give the correct SADs are all about 0.1 $mg/cm^2$. The corresponding PMAs are about 0.02 $mg/cm^2$. While this is enough developed mass per unit area to give uniform solids on smooth papers, it may not be enough to give uniform coverage on rough papers. It is desirable to increase DMA when printing to rough paper and to adjust DMA continuously over a range from 0.1–0.5 $mg/cm^2$ in response to different paper roughness. It is further desirable to adjust DMA from job to job so that the customer can use different papers for successive jobs and to maintain PMA at least approximately constant when DMA is adjusted.

One aspect of the present invention uses high and low pigment loading of toners to allow the DMA to be increased without increasing the PMA.

SUMMARY OF THE INVENTION

The present invention extends custom color control techniques by using a high and a low pigment loaded toner of the same color for various purposes. In one application, a large gamut of colors and fine control of color, while using a minimum set of toner colors, is accomplished by using only 6–7 colored pigments with each color incorporated into both high and low pigment loaded toners. Another use of the high/low pigment loaded toners increases developed mass per unit area (DMA) for rough papers without increasing pigment mass per unit area (PMA) by either mixing high and low pigment-loaded toners or by mixing a high pigment-loaded toner with an unpigmented toner to obtain the desired custom color.

BRIEF DESCRIPTION OF THE DRAWINGS

Other features of the present invention will become apparent as the following description proceeds and upon reference to the drawings, in which.

DETAILED DESCRIPTION OF THE INVENTION

Figure 1:
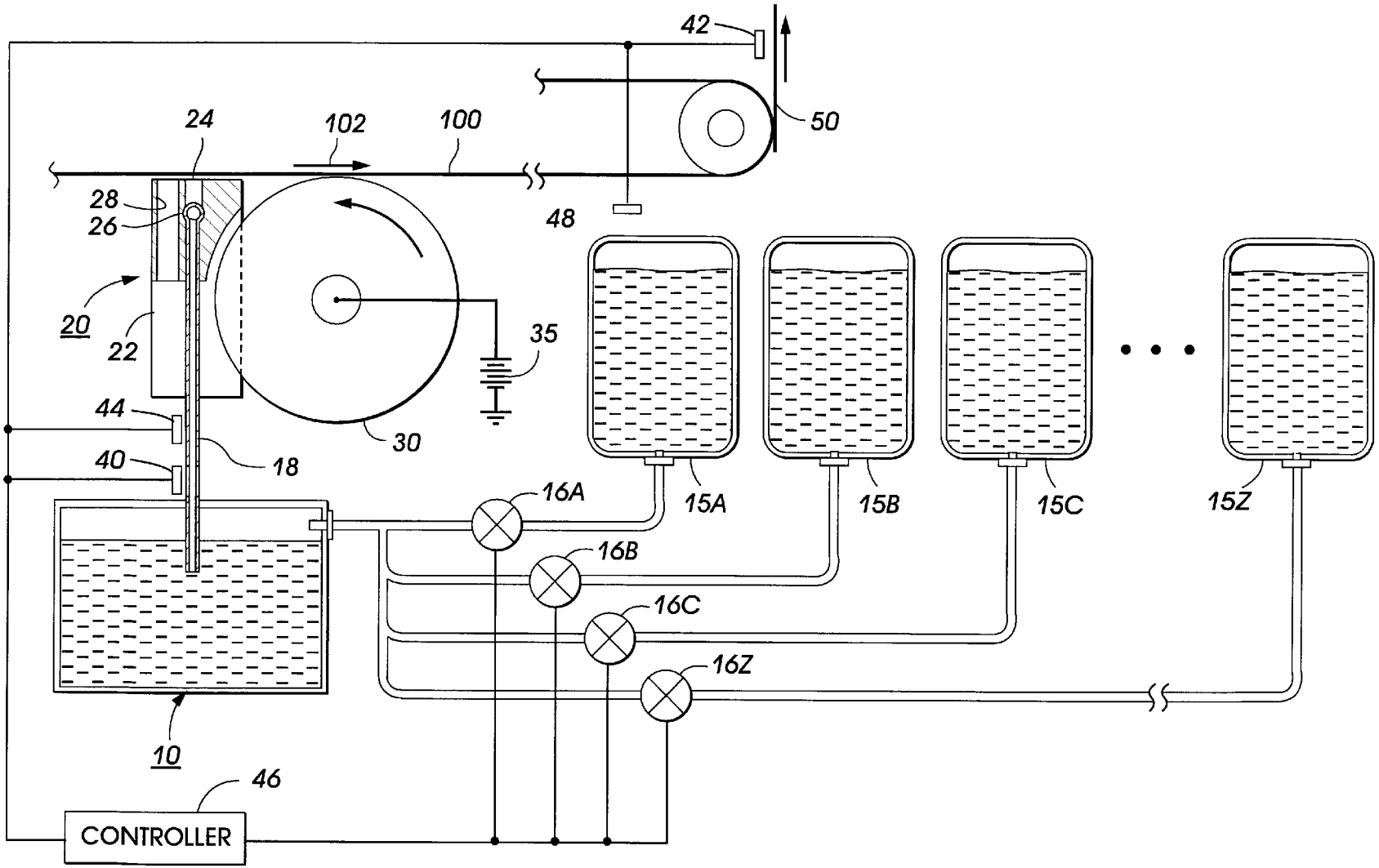
FIG. 1 shows a schematic view of an electrostatographic developing station for developing an electrostatic latent image.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Since the art of electrostatographic printing is well known, it is noted that several concepts for electrostatographic highlight, spot and/or high fidelity color imaging systems which could make beneficial use of the color mixing and control system of the present invention have been disclosed in the relevant patent literature. One of the more elegant and practical of these concepts is directed toward single-pass highlight color tri-level imaging. In general, tri-level imaging involves the creation of two different electrostatic latent images at different voltage levels generated in a single imaging step, with a background or non-image area at yet another intermediate voltage level. Typically, one latent image is developed using charged-area development (CAD) techniques, while the other is developed via discharged-area development (DAD) techniques. This is accomplished by using positively charged toner for one color and negatively charged developing materials for the other, in separate housings. For example, by providing one developing material in black and the other in a selected color for highlighting, two different color images can be created on a single output document in a single processing cycle. This concept for tri-level xerography, is disclosed in U.S. Pat. No. 4,078,929, issued in the name of Gundlach, incorporated by reference herein. As disclosed therein, tri-level xerography involves the modification of known xerographic processes, such that the xerographic contrast on the charge retentive surface or photoreceptor is divided three ways, rather than two, as in the case in conventional xerography. Thus the photoreceptor is imagewise exposed such that one image, corresponding to charged image areas, is maintained at the full photoreceptor potential (V ddp or V cad) while the other image, which corresponds to discharged image areas is exposed to discharge the photoreceptor to its residual potential, i.e. V dad. The background areas are formed by exposing areas of the photoreceptor at V ddp to reduce the photoreceptor potential to halfway between the V cad and V dad potentials, and is referred to as Vw or V white.

While the present invention may find particular application in tri-level highlight color imaging, it will become apparent from the following discussion that the color mixing and control system of the present invention may be equally well-suited for use in a wide variety of printing machines and is not necessarily limited in its application to the particular single-pass highlight tri-level electrostatographic process described by Gundlach. In fact, it is intended that the color mixing and control system of the present invention may be extended to any printing or painting process intended to produce a customer selectable color image area including multi-color printing machines which may be provided with an ancillary customer selectable color development housing, as well as printing machines which carry out ionographic printing processes and the like. More generally, while the color mixing and control system of the present invention will hereinafter be described in connection with one of numerous various embodiments thereof, it will be understood that the description of the invention is not intended to limit the scope of the present invention to this preferred embodiment. On the contrary, the present invention is intended to cover all alternatives, modifications, and equivalents as may be included within the spirit and scope of the invention as defined by the appended claims.

Turning now to FIG. 1, an exemplary apparatus for developing an electrostatic latent image, wherein liquid developing materials are utilized is depicted in schematic form. Typically, a highlight color electrostatographic printing machine would include at least two developing apparatus operating with different color liquid developing materials for developing latent image areas into different colored visible images. By way of example, in a tri-level system of the type described hereinabove, a first developer apparatus might be utilized to develop the positively charged image area with black colored liquid developing material, while a second developer apparatus might be used to develop the negatively charged image area image with a customized color. In the case of liquid developing materials, each different color developing material comprises pigmented toner or marking particles, as well as charge control additives and charge directors, all disseminated through a liquid carrier, wherein the marking particles are charged to a polarity opposite in polarity to the charged latent image to be developed.

The developing apparatus of FIG. 1 operates primarily to transport liquid developer material into contact with a latent image on a photoreceptor surface, generally identified by reference numeral 100, wherein the marking particles are attracted, via electrophoresis, to the electrostatic latent image for creating a visible developed image thereof. With respect to the developing material transport and application process, the basic manner of operation of each developer apparatus is generally identical to one another and the developing apparatus shown in FIG. 1 represents only one of various known apparatus that can be utilized to apply liquid developing material to the photoconductive surface. It will be understood that the basic development system incorporating the mixing and control system of the present invention may be directed to liquid or dry powder development, and may take many forms, as for example, systems described in U.S. Pat. Nos. 3,357,402; 3,618,552; 4,733,273; 4,883,018; 5,270,782 and 5,355,201 among numerous others. Such development systems may be utilized in a multicolor electrophotographic printing machine, a highlight color machine, or in a monochromatic printing machine. In general, the only distinction between each developer unit is the color of the liquid developing material therein. It will be recognized however, that only developer applicators which require the capability of generating customer selectable color outputs will be provided with the customer selectable color mixing and control system of the present invention.

Focusing on the development process before describing the color mixing and control system of the present invention, in the exemplary developing apparatus of FIG. 1, liquid developing material is transported from a supply reservoir 10 to the latent image on the photoreceptor 100 via a liquid developing material applicator 20. Supply reservoir 10 acts as a holding receptacle for providing an operative solution of liquid developing material comprised of liquid carrier, a charge director compound, and toner material, which, in the case of the customer selectable color application of the present invention, includes a blend of different colored marking particles. In accordance with the present invention, a plurality of replaceable supply dispensers 15A–15Z, each containing a concentrated supply of marking particles and carrier liquid corresponding to a basic color component in a color matching system, are provided in association with the operational supply reservoir 10 and coupled thereto for replenishing the liquid developing material therein, as will be described.

The exemplary developing material applicator 20 includes a housing 22, having an elongated aperture 24 extending along a longitudinal axis thereof so as to be oriented substantially transverse to the surface of photoreceptor 100, along the direction of travel thereof as indicated by arrow 102. The aperture 24 is coupled to an inlet port 26 which is further coupled to reservoir 10 via transport conduit 18. Transport conduit 18 operates in conjunction with aperture 24 to provide a path of travel for liquid developing material being transported from reservoir 10 and also defines a developing material application region in which the liquid developing material can freely flow in order to contact the surface of the photoreceptor belt 100 for developing the latent image thereon. Thus, liquid developing material is pumped or otherwise transported from the supply reservoir 10 to the applicator 20 through at least one inlet port 26, such that the liquid developing material flows out of the elongated aperture 24 and into contact with the surface of photoreceptor belt 100. An overflow drainage channel (not shown), partially surrounds the aperture 24, may also be provided for collecting excess developing material which may not be transferred over to the photoreceptor surface during development. Such an overflow channel would be connected to an outlet channel 28 for removal of excess or extraneous liquid developing material and, preferably, for directing this excess material back to reservoir 10 or to a waste sump whereat the liquid developing material can preferably be collected and the individual components thereof can be recycled for subsequent use.

Slightly downstream of and adjacent to the developing material applicator 20, in the direction of movement of the photoreceptor surface 100, is an electrically biased developer roller 30, the peripheral surface thereof being situated in close proximity to the surface of the photoreceptor 100. The developer roller 30 rotates in a direction opposite the movement of the photoconductor surface 100 so as to apply a substantial shear force to the thin layer of liquid developing material present in the area of the nip between the developer roller 30 and the photoreceptor 100, for minimizing the thickness of the liquid developing material on the surface thereof. This shear force removes a predetermined amount of excess liquid developing material from the surface of the photoreceptor and transports this excess developing material in the direction of the developing material applicator 20. The excess developing material eventually falls away from the rotating metering roll for collection in the reservoir 10 or a waste sump (not shown). A DC power supply 35 is also provided for maintaining an electrical bias on the metering roll 30 at a selected polarity and magnitude such that image areas of the electrostatic latent image on the photoconductive surface will attract marking particles from the developing material for developing the electrostatic latent image. This electrophoretic development process minimizes the existence of marking particles in background regions and maximizes the deposit of marking particles in image areas on the photoreceptor.

In operation, liquid developing material is transported in the direction of the photoreceptor 100, filling the gap between the surface of the photoreceptor and the liquid developing material applicator 20. As photoreceptor 100 moves in the direction of arrow 102, a portion of the liquid developing material in contact with the photoreceptor moves therewith toward the developing roll 30 where marking particles in the liquid developer material are attracted to the electrostatic latent image areas on the photoreceptor. The developing roller 30 also meters a predetermined amount of liquid developing material adhering to the photoconductive surface of belt 100 and acts as a seal to prevent extraneous liquid developing material from being carried on by the photoreceptor.

As previously indicated, the liquid developing materials of the type suitable for electrostatographic printing applications generally comprise marking particles and charge directors dispersed in a liquid carrier medium, with an operative solution of the developing material being stored in reservoir 10. Generally, the liquid carrier medium is present in a large amount in the liquid developing material composition, and constitutes that percentage by weight of the developer not accounted for by the other components. The liquid medium is usually present in an amount of from about 80 to about 99.5 percent by weight, although this amount may vary from this range provided that the objectives of the present invention can be achieved. By way of example, the liquid carrier medium may be selected from a wide variety of materials, including, but not limited to, any of several hydrocarbon liquids conventionally employed for liquid development processes, including hydrocarbons, such as high purity alkanes having from about 6 to about 14 carbon atoms, such as Norpar® 12, Norpar® 13, and Norpar® 15, and including isoparaffinic hydrocarbons such as Isopar® G, H, L, and M, available from Exxon Corporation. Other examples of materials suitable for use as a liquid carrier include Amsco® 460 Solvent, Amsco® OMS, available from American Mineral Spirits Company, Soltrol®, available from Phillips Petroleum Company, Pagasol®, available from Mobil Oil Corporation, Shelisol®, available from Shell Oil Company, and the like. Isoparaffinic hydrocarbons provide a preferred liquid media, since they are colorless, and environmentally safe.

The marking or so-called toner particles of the liquid developing material can comprise any particle material compatible with the liquid carrier medium, such as those contained in the developers disclosed in, for example. U.S. Pat. Nos. 3,729,419; 3,841,893; 3,968,046; 4,476,210; 4,707,429; 4,762,764; 4,794,651; and 5,451,483, among others, the disclosures of each of which are totally incorporated herein by reference. Preferably, the toner particles should have an average particle diameter ranging from about 0.2 to about 10 microns, and most preferably between about 0.5 and about 2 microns. The toner particles may be present in the operative liquid developing material in amounts of from about 0.5 to about 20 percent by weight, and preferably from about 1 to about 4 percent by weight of the developer composition. The toner particles can consist solely of pigment particles, or may comprise a resin and a pigment; a resin and a dye; or a resin, a pigment, and a dye or resin alone. Other agents including charge adjuvants (also called charge control agents, abbreviated CCAs) may be optionally included.

Examples of thermoplastic resins include ethylene vinyl acetate (EVA) copolymers, (ELVAX® resins, E.I. DuPont de Nemours and Company, Wilmington, Del.); copolymers of ethylene and an a-b-ethylenically unsaturated acid selected from the group consisting of acrylic acid and methacrylic acid; copolymers of ethylene (80 to 99.9 percent), acrylic or methacrylic acid (20 to 0.1 percent)/alkyl (C1 to C5) ester of methacrylic or acrylic acid (0.1 to 20 percent); polyethylene; polystyrene; isotactic polypropylene (crystalline); ethylene ethyl acrylate series available under the trademark BAKELITE® DPD 6169, DPDA 6182 NATURALÔ (Union Carbide Corporation, Stamford, Conn.; ethylene vinyl acetate resins like DQDA 6832 Natural 7 (Union Carbide Corporation); SURLYN® ionomer resin (E.I. DuPont de Nemours and Company); or blends thereof; polyesters; polyvinyl toluene; polyamides; styrene/butadiene copolymers; epoxy resins; acrylic resins, such as a copolymer of acrylic or methacrylic acid, and at least one alkyl ester of acrylic or methacrylic acid wherein alkyl is 1 to 20 carbon atoms, such as methyl methacrylate (50 to 90 percent)/methacrylic acid (0 to 20 percent)/ethylhexyl acrylate (10 to 50 percent); and other acrylic resins including ELVACITE® acrylic resins (E.I. DuPont de Nemours and Company); or blends thereof. Preferred copolymers selected in embodiments are comprised of the copolymer of ethylene and an a-b-ethylenically unsaturated acid of either acrylic acid or methacrylic acid. In a preferred embodiment, NUCREL® resins available from E.I. DuPont de Nemours and Company like NUCREL 599®, NUCREL 699®, or NUCREL 960® are selected as the thermoplastic resin.

In embodiments, the marking particles are comprised of thermoplastic resin, a charge adjuvant, and the pigment, dye, or other colorant. Therefore, it is important that the thermoplastic resin and the charge adjuvant be sufficiently compatible that they do not form separate particles, and that the charge adjuvant be insoluble in the hydrocarbon liquid carrier to the extent that no more than 0.1 weight percent be soluble therein. Any suitable charge director such as, for example, a mixture of phosphate ester and aluminum complex can be selected for the liquid developers in various effective amounts, such as, for example, in embodiments from about 1 to 1,000 milligrams of charge director per gram of toner solids and preferably 10 to 100 milligrams/gram. Developer solids include toner resin, pigment, and optional charge adjuvant.

Liquid developing materials generally contain a colorant dispersed in the resin particles. Colorants, such as pigments or dyes like black, white, cyan, magenta, yellow, red, blue, green, brown, and mixtures wherein any one colorant may comprise from 0.1 to 99.9 weight percent of the colorant mixture with a second colorant comprising the remaining percentage thereof are preferably present to render the latent image visible. The colorant may be present in the resin particles in an effective amount of, for example, from about 0.1 to about 60 percent, and preferably from about 10 to about 30 percent by weight based on the total weight of solids contained in the developer. The amount of colorant selected may vary depending on the use of the developer; for instance, if the toned image is to be used to form a chemical resist image no pigment is necessary. Clear, unpigmented toners may be used to lighten the images printed. Examples of colorants such as pigments which may be selected include carbon blacks available from, for example, Cabot Corporation (Boston, Mass.), such as MONARCH 1300®, REGAL 330® and BLACK PEARLS® and color pigments like FANAL PINK®, PV FAST BLUE®, Titanium Dioxide (white) and Paliotol Yellow DI 155; as well as the numerous pigments listed and illustrated in U.S. Pat. Nos. 5,223,368; 5,484,670, the disclosures of which are totally incorporated herein by reference.

As previously discussed, in addition to the liquid carrier vehicle and toner particles which typically make up the liquid developer materials, a charge director compound (sometimes referred to as a charge control additive) is also provided for facilitating and maintaining a uniform charge on the marking particles in the operative solution of the liquid developing material by imparting an electrical charge of selected polarity (positive or negative) to the marking particles.

Examples of suitable charge director compounds and charge control additives include lecithin, available from Fisher Inc.; OLOA 1200, a polyisobutylene succinimide, available from Chevron Chemical Company; basic barium petronate, available from Witco Inc.; zirconium octoate, available from Nuodex; as well as various forms of aluminum stearate; salts of calcium, manganese, magnesium and zinc; heptanoic acid; salts of barium, aluminum, cobalt, manganese, zinc, cerium, and zirconium octoates and the like. The use of quaternary charge directors as disclosed in the patent literature may also be desirable. The charge control additive may be present in an amount of from about 0.01 to about 3 percent by weight, and preferably from about 0.02 to about 0.20 percent solids by weight of the developer composition.

The application of developing material to the photoconductive surface clearly depletes the overall amount of the operative solution of developing material in supply reservoir 10. In the case of the liquid developing materials, marking particles are depleted in the image areas; carrier liquid is depleted in the image areas (trapped by marking particles) and in background areas, and may also be depleted by evaporation; and charge director is depleted in the image areas (trapped in the carrier liquid), in the image areas adsorbed onto marking particles, and in the background areas. In general practice, therefore, reservoir 10 is continuously replenished, as necessary, by the addition of developing material or selective components thereof, for example in the case of liquid developing materials, by the addition of liquid carrier, marking particles, and/or charge director into the supply reservoir 10. Since the total amount of any one component making up the developing material utilized to develop the image may vary as a function of the area of the developed image areas and the background portions of the latent image on the photoconductive surface, the specific amount of each component of the liquid developing material which must be added to the supply reservoir 10 varies with each development cycle. For example, a developed image having a large proportion of printed image area will cause a greater depletion of marking particles and/or charge director from a developing material reservoir as compared to a developed image with a small amount of printed image area.

Thus, it is known in the art that, while the rate of the replenishment of the liquid carrier component of the liquid developing material may be controlled by simply monitoring the level of liquid developer in the supply reservoir 10, the rate of replenishment of the marking particles, and/or the charge director components of the liquid developing material in reservoir 10 must be controlled in a more sophisticated manner to maintain a predetermined concentration of the marking particles and the charge director in the operative solution stored in the supply reservoir 10. Systems have been disclosed in the patent literature and otherwise for systematically replenishing individual components making up the liquid developing material (liquid carrier, marking particles and/or charge director) as they are depleted from the reservoir 10 during the development process. See, for example, commonly assigned U.S. patent application Ser. No. 08/551,381 and previously filed patent application D/95434.

The full gamut of Pantone color printing can be spanned by 6–7 primary colors for example: cyan, blue, magenta red, yellow, green; or red, orange yellow, green, cyan, blue, purple. The color gamut of any set of primary colors is further expanded as the Pigment Mass per unit Area (PMA) is increased. For example, color measurements following deposition of controlled DMAs show that increasing the current liquid xerographic PMAs by 50% would increase the printable color gamut by 27%. However, these high pigment loadings would make the final printed color very sensitive to changes in composition. For example, at current PMAs the $\Delta$ E (color difference value) between 100% cyan and 95% cyan +5% yellow is 11.7. If both cyan and yellow PMAs are increased 50% then the $\Delta$ E between the same two toned layer compositions is 17.3. The spacing between adjacent Pantone CMS® colors is $\Delta E \equiv 5–15$. As is known, such color combinations are most sensitive to changes in the minority color's contribution.

A current control system for custom mixed colors uses the fact that the mobilities of the primary colors are approximately equal. Then the ratio of primary color Density Mass per unit Area (DMA) equals the ratio of primary color concentrations in the toner supply tank. Since the total concentration of toner solids in the toner supply tank is about 1 wt %, control of component ratios to less than 5% requires control to less than 0.05 wt%. The present invention solves this problem of controlling the concentration of toner solids by making two toners from each primary pigment. For instance, a toner should be made with about 20% loading of yellow 012 pigment and another toner made with about 5% loading of yellow 012 pigment. Then, the desired 95/5 ratio of cyan and yellow DMA can be achieved with 0.95 wt% Cyan toner and 0.2 wt% low-pigmented Yellow toner, rather than 0.05 wt% high-pigmented yellow toner.

The present invention can be used when one of the primary toners is white or black, the white or black toner being added to adjust the lightness/darkness of the printed image without halftoning or overprinting with another color. When one of the colored components is low pigment-loaded, less white or unpigmented toner is needed.

In a particular embodiment of the present invention, a plurality of differently colored developing material supply dispensers 15A, 15B, 15C, . . . 15Z, each coupled to the operative supply reservoir via an associated valve member 16A, 16B 16C, . . . 16Z, or other appropriate liquid flow control device. Preferably, each supply dispenser contains a developing material concentrate of a known basic or primary color such as Cyan, Magenta, and Yellow. In one specific embodiment, the replenishment system includes as few as sixteen supply dispensers, wherein each supply container provides a different basic color liquid developing material corresponding to six or seven basic or constituent colors of the Pantone® Color Matching System as well as black and white. This embodiment contemplates that color formulations conveniently provided by the Pantone® System can be utilized to produce about a thousand desirable colors and shades in a customer selectable color printing environment. Using this system, as few as two different color liquid developing materials, from supply containers 15A and 15B for example, can be combined in reservoir 10 to expand the color gamut of customer selectable colors far beyond the colors available via halftone imaging techniques.

An essential component of the developing material color mixing and control system of the present invention is a color control system. That is, since different components of the blended liquid developing material in reservoir 10 may develop at different rates, a customer selectable color mixing controller 46 is provided in order to determine appropriate amounts of each color liquid developing material in supply containers 15A, 15B . . . or 15Z which can be systematically added to supply reservoir 10, and to controllably supply each of such appropriate amounts of liquid developing material. Controller 46 may take the form of any known microprocessor based memory and processing device, as are well known in the art.

The approach provided by the color mixing control system of the present invention includes a mixed developer sensing device 40; for example, the liquid developing material in the reservoir 10. While sensing device 40 is shown in FIG. 1 in a position so as to monitor the liquid developing material reservoir 10 to the developing material applicator 20, it will be understood that various multi-wavelength light attenuation sensors may be utilized to detect the color of the liquid developing material including devices which are submerged in the liquid developing material reservoir 10, or devices which monitor the light attenuation across the entire volume of the reservoir 10. Sensor 40 is connected to controller 46 for controlling the flow of the variously colored replenishing liquid developing materials from dispensers 15A–15Z, corresponding to the basic constituent colors of a color matching system, to be delivered into the liquid developing material supply reservoir 10 from each of the supply containers 15A–15Z. In a preferred embodiment, as shown in FIG. 1, the controller 46 is coupled to control valves 16A–16Z for selective actuation thereof to control the flow of liquid developing material from each supply container 15A–15Z. It will be understood that these valves may be replaced by pump devices or any other suitable flow control mechanisms as known in the art, so as to be substituted thereby.

In one particular embodiment of the present invention, sensor 40 is provided in the form of a spectrophotometer of the type well known in the art, such that spectrographic methods can be utilized to provide color mixing control. A spectrophotomer measures the transmission or apparent reflectance of visible light as a function of wavelength, permitting accurate analysis of color or accurate comparison of luminous intensities of two sources or specific wavelengths. The optical spectra measured by sensor 40 are subsequently transmitted to the controller 46, which compares the measured optical spectra to target optical spectra (stored in memory). This information, in combination with the known transmission, reflection and/or emission spectra of each of the primary colors components, including the high and low pigmented primary color components, contained in supply containers 15A–15Z, is used to assist in determining the appropriate amounts of each color component which should be added to the reservoir 10 via actuation of valves 16A–16Z, respectively. An additional sensor 42 as described in U.S. Pat. No. 5,897,239 will allow the target toner supply color to be adjusted in response to measured differences between the customer-selected color and the actual printed color.

Current liquid xerographic toner supply systems include means for replenishment and control of toner properties. The toner supply tank is replenished with carrier fluid when supply volume drops; with charge director fluid, when supply conductivity drops and with toner concentrate when supply solids concentration drops. At present, supply concentration is measured by toner optical transmission. The higher the solids concentration is, the lower the transmission is. For each color a calibration curve of transmission versus solids concentration is measured, then used to sense solids concentration.

The principle method of measuring toner concentration in a liquid xerographic toner is by optical attenuation as described in the above references. A light source and a detector are placed 1–25 mm apart and the light passes through 0.025–0.250 mm of toner. The detector's signal is inversely proportional to the concentration of the toner in the region between the light and the detector. The calibration curve relating toner concentration to detector signal is dependent on the color of the toner particles. This method works well for four color (C, M, Y, K) process color printing. However, it is desirable to be able to print a large number of custom colors (e.g. about 1000 in the Pantone color system). For a mixture of two colors (e.g. blue and red), the toner transmission spectrum is measured and added to the components as necessary. However, many custom colors include white or black components. In order to control both a white or black component and a color component, it is desirable to have an independent measure of total toner solids.

Yet another type of sensor, fluorescent sensing device 44, can provide a color independent measurement of toner concentration solids. It is possible to attach a fluorescent dye molecule to the toner particle. To avoid changing the color of the toner it is necessary that the molecule not fluoresce in response to ordinary illumination, any appropriate fluorescent dye molecule may be used. For example, molecule $\Phi$-$\Phi$-$\Phi$-$SO_2Cl$ is excited by 250 nm light and emits in the blue region; 250 nm light is an insignificant component of ordinary illumination so this molecule can be used to tag toner of any color. The luminescent signal will then be proportional to the amount of this molecule present in the toner. In one version of this invention, all toner molecules are equally tagged with the same fluorescent molecule. The fluorescent signal is then a measure of the total mass per unit volume of toner particles. In another version of this invention, only the white or black components are tagged. Then, the fluorescent signal measures one component of the toner and the toner transmission spectrum measures the toner's color.

In another version of the invention some of the colored components may be fluorescent. In this case, the colored components fluorescence is part of their color. Several fluorescent wavelengths are measured and these measurements provide especially strong, specific measures of individual component concentrations.

In yet another version of the invention, both toner particles and the charge director are tagged. In this version the toner and the charge director must emit at different wavelengths so that the two fluorescent signals provide independent measurements of toner particle concentration and charge director concentration.

In yet another version of this invention, the liquid toner is diluted before being introduced into the optical sensor. This dilution reduces the probability of multiple scattering events and simplifies the relation between the concentration of tagged species and the strength of the fluorescent emission.

In all versions of the invention, it is necessary that the fluorescent molecule be firmly and permanently attached to the toner particle. The fluorescent molecule must not detach from or wash off of the toner particle. To achieve this, a fluorescent molecule must be chosen which will bond covalently to some component of the particle. The covalent bonding could be to some part of the toner resin or the bonding could be to some part of the Charge Control Agent (CCA) which is itself covalently bonded to the resin.

When Nucrel resins are the toner resin in liquid ink development the most likely site of covalent attachment of the fluorescing molecule to the toner will be through the Nucrel carboxylic acid groups since there remains a stochiometric excess thereof even after all the CCA has covalently attached to some of these carboxylic acid groups. The covalent attachment would best be effected readily in the 2–3 hour attritor hot stage (about 100 degrees Celsius) to minimize cost. Carboxylic acid groups can be made to react with various organic functional groups on a suitable fluorophore but generally speaking catalysts will have to be omitted so as not to interfere with toner charging. For cases where the acid sites are involved in particle charging, the fluorophore concentration should be kept low enough that consumption of nearly all the acid groups will not occur. It is also likely that only the surface attached fluorophores will be active because the toner pigment may absorb much of the incident radiation intended for the fluorophore. So the objective here would be to covalently attach just enough fluorophore at the surface leaving sufficient residual carboxylic acid groups available for the normal proton transfer charging mechanism. Carboxylic acid-fluorophore addition chemistry is preferred for the covalent attachment wherein there is no chemical by-product or if there is one, it is a gas by-product which readily leaves the attritor. By-products, like catalysts, could coat the toner particle and thereby interfere with toner charging.

Another application of varying the high and low pigment concentrations of primary Pantone colors is the ability to develop more mass per unit area when printing on rough papers than when printing on smooth papers. However, when printing process colors, it is necessary to maintain solid area optical densities (SADs) at approximately constant levels. In order to accomplish this, the DMA is increased without increasing the pigment mass per unit area (PMA) by either mixing high and low pigment loaded toners or by mixing a high pigment loaded toner with an unpigmented toner. This is accomplished by maintaining toner pigment loading by sensing both toner optical transmission and toner percent solids.

It is desirable for the DMA to be adjusted from job to job, without substantially changing PMA. For example, two concentrates for each color can be used; one with high pigment loading and a second with low pigment loading. For each color, the two concentrates are combined in varying proportions to achieve the desired average pigment loading.

Another example of this invention uses four colored toners with high pigment loadings and one unpigmented toner. For each color, the pigmented concentrate and the unpigmented concentrate are combined in varying proportions to achieve the desired average pigment loading.

In any version of the invention, the wt% solids concentration of toner in the supply must be sensed and controlled separately from the pigment concentration(s) in the toner supply. The pigment concentration(s) will clearly effect the optical transmission of the toner supply. However, scattering from toner particles will also reduce optical transmission. A second sensor, for total solids concentration supplements any sensor based on optical transmission. Such a sensor is fluorescent sensor 44 wherein one or more components are tagged with a fluorescent dye. Preferably, all toner resin could be tagged with fluorescent dye, whether the resin is subsequently incorporated into low-pigmented toner, high-pigmented toner, or unpigmented toner.

As explained above, addition of the concentrates is governed by control system 46 using sensors 40, 42 and/or 44. This control system may also take target PMA and target DMA directly from the user and add the two concentrates to achieve these targets. In addition, the control system may be given the paper roughness, or may sense the paper roughness and add the concentrates to achieve PMA and DMA targets previously determined to be appropriate for the paper roughness.

The control system will also adjust the photoreceptor voltage and/or development voltages and/or metering roll voltages to achieve the target DMA. The control system may include sensor 48, such as a capacitive sensor, for measuring the mass developed on the photoreceptor and feedback loops for adjusting one or more voltage to achieve the target DMA.

It is, therefore, apparent that there has been provided in accordance with the present invention, a method and apparatus for producing custom colors for printing processes with high and low pigment concentrations that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for providing an operative color material for producing a customer selectable color output image, comprising:

a first set of a plurality of color material supply dispensers, each containing a different color concentrate corresponding to a basic color component of a color matching system and each having a first pigment mass fraction which is a relatively high pigment mass fraction;

a second set of a plurality of color material supply dispensers, each containing a different color concentrate corresponding to the colors in the first set of color material supply dispensers and each having a second pigment mass fraction which is a relatively low pigment mass fraction;

a color material reservoir for providing an operative supply of color material for printing the image so as to generate the output image of a specified color, the reservoir having each of the color material supply dispensers coupled thereto;

a dispensing system for systematically dispensing a selective amount of color material concentrate from at least a selected one of the color material supply dispensers to the color material reservoir for providing a selected amount of a selected basic color component to the supply of operative color material;

a first sensing device for monitoring a first characteristic of the operative supply of color material;

a controller coupled to the sensing device for selectively actuating the systematic dispensing system in response to the first characteristic sensed by the first sensing device to adjust the operative supply of color material so as to produce the customer selectable color output image.

2. The apparatus of claim 1, wherein the first sensing device IS spectrophotometer.

3. The apparatus of claim 2, wherein the first sensing device senses the operative supply of color material in the color material reservoir.

4. The apparatus of claim 1, wherein the first sensing device senses a printed image produced by the operative supply of color material.

5. The apparatus of claim 1, wherein the color material is tagged with a fluorescent dye and the first sensing device is a fluorescent material sensor.

6. The apparatus of claim 5, wherein only black and white color material are tagged with fluorescent dye.

7. The apparatus of claim 2, further comprising a second sensor to sense toner concentration.

8. The apparatus of claim 7, wherein the second sensor is a fluorescent material sensor.

9. The apparatus of claim 7, wherein the controller controls the dispenser to increase developed mass per unit area while maintaining pigment mass per unit area relatively constant.

10. The apparatus of claim 9, further comprising:

a rough paper sensor which sends a signal to the controller so that the dispensing system can dispense the appropriate developed mass per unit area.

11. A method for providing an operative color developing material for developing an image for producing a customer selectable color output image, comprising:

dispensing different color developing material concentrate from a first set of a plurality of color material supply dispensers, each containing a different color concentrate corresponding to a basic color component of a color matching system and each having a first pigment mass fraction which is a relatively high pigment mass fraction and a second set of a plurality of color material supply dispensers, each containing a different color concentrate corresponding to the colors in the first set of color material supply dispensers and each having a second pigment mass fraction which is a relatively low pigment mass per unit area;

supplying an operative developing material to a developing material reservoir for providing an operative supply of developing material for printing the image so as to generate the output image of a specified color, the reservoir having each of the color material supply dispensers coupled thereto;

monitoring a first characteristic of the operative supply of color material with a first sensing device;

selectively controlling a dispensed amount of developing material concentrate from at least a selected one of said developing material supply dispensers to said developing material reservoir for providing a selected amount of a selected basic color component to said supply of operative developing material with a control system coupled to said first sensing device in response to the first characteristic sensed by the first sensing device to adjust the operative supply of color material so as to produce the customer selectable color output image.

* * * * *